US012515293B2

(12) United States Patent
Müller et al.

(10) Patent No.: US 12,515,293 B2
(45) Date of Patent: Jan. 6, 2026

(54) VIBRATORY GRINDING DEVICE

(71) Applicant: Rösler Holding GmbH, Bad Staffelstein (DE)

(72) Inventors: Ralf Müller, Großheirath (DE); Dennis Eichenberg, Marktzeuln (DE)

(73) Assignee: Rösler Holding GmbH, Bad Staffelstein (DE)

( * ) Notice: Subject to any disclaimer, the term of this patent is extended or adjusted under 35 U.S.C. 154(b) by 1168 days.

(21) Appl. No.: 17/098,374

(22) Filed: Nov. 14, 2020

(65) Prior Publication Data

US 2021/0146499 A1 May 20, 2021

(30) Foreign Application Priority Data

Nov. 15, 2019 (DE) ..... 102019130933.6

(51) Int. Cl.
*B24B 31/06* (2006.01)

(52) U.S. Cl.
CPC ..... *B24B 31/06* (2013.01)

(58) Field of Classification Search
CPC ..... B24B 1/04; B24B 31/003; B24B 31/064; B24B 31/116; B24B 49/08; B24B 49/14; B24B 31/06; B24B 31/02; B24B 31/10; B24B 31/006; A47L 9/102; A47L 9/20; A47L 9/10
See application file for complete search history.

(56) References Cited

U.S. PATENT DOCUMENTS

| | | | | |
|---|---|---|---|---|
| 3,073,069 | A | 1/1963 | Balz | |
| 4,693,037 | A * | 9/1987 | McNeil | B24B 31/073 134/132 |
| 5,305,554 | A * | 4/1994 | Emken | B24B 31/12 451/60 |
| 6,764,384 | B1 * | 7/2004 | Kleer | F04D 29/321 451/36 |
| 9,925,636 | B2 * | 3/2018 | Maeda | B24B 31/06 |
| 10,040,164 | B2 | 8/2018 | Gegenheimer | |
| 10,814,417 | B2 * | 10/2020 | Boccadoro | B23H 11/00 |
| 11,607,757 | B2 * | 3/2023 | Wern | B24B 39/006 |
| 2003/0017792 | A1 * | 1/2003 | Rivir | B24C 9/00 451/99 |
| 2003/0027509 | A1 | 2/2003 | Gegenheimer | |
| 2003/0220055 | A1 * | 11/2003 | Kajimoto | B24B 57/02 451/60 |

(Continued)

FOREIGN PATENT DOCUMENTS

| | | | |
|---|---|---|---|
| CH | 669550 | A5 * | 2/1987 |
| DE | 103849 | | 12/1974 |

(Continued)

OTHER PUBLICATIONS

Compressor Basics_ Side Channel—Air Compressor Works, Inc_, https://aircompressorworks.com/compressor-basics-side-channel/ (Year: 2017).*

(Continued)

*Primary Examiner* — Monica S Carter
*Assistant Examiner* — Sarah Akyaa Fordjour
(74) *Attorney, Agent, or Firm* — Dickinson Wright PLLC

(57) ABSTRACT

A vibratory grinding device has a work container and a grinding body removal device by which grinding bodies can be led out of the work container.

20 Claims, 4 Drawing Sheets

(56) References Cited

U.S. PATENT DOCUMENTS

Figure 2:
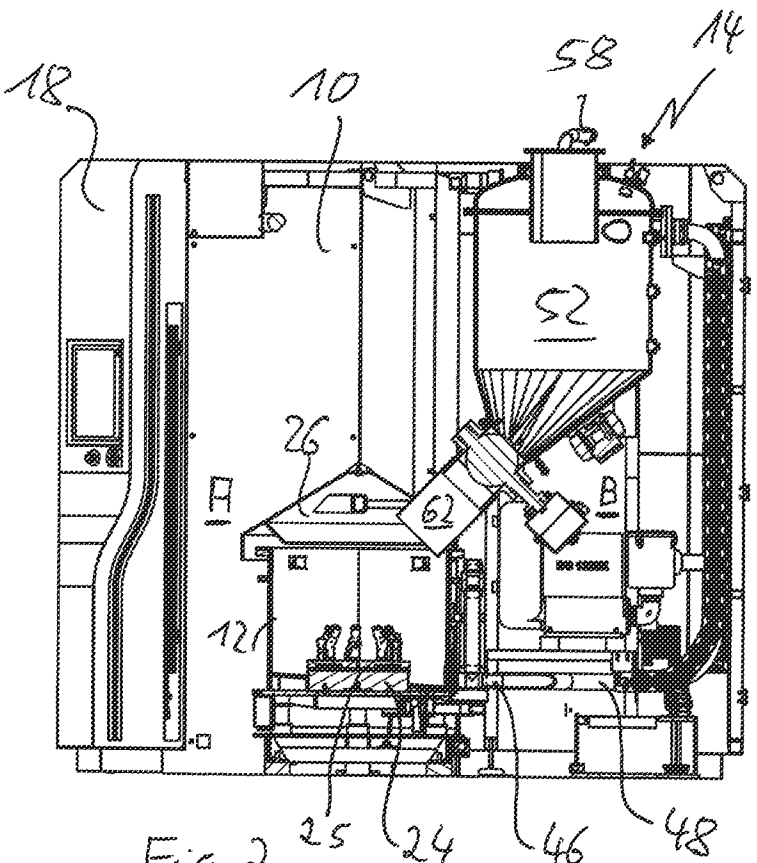

| | | | | |
|---|---|---|---|---|
| 2005/0186888 | A1* | 8/2005 | Gadd | B24C 7/0007 451/36 |
| 2008/0057840 | A1* | 3/2008 | Huang | B24C 5/00 451/91 |
| 2010/0154161 | A1* | 6/2010 | Takahashi | B23Q 11/0046 15/347 |
| 2017/0050285 | A1* | 2/2017 | Lu | B24B 49/14 |
| 2017/0361422 | A1 | 12/2017 | Brand et al. | |
| 2020/0189068 | A1* | 6/2020 | Sanders | B01F 25/30 |

FOREIGN PATENT DOCUMENTS

| | | | |
|---|---|---|---|
| DE | 3538909 | C2 | 10/1988 |
| DE | 19906915 | A1 | 8/2000 |
| DE | 102004052881 | A1 | 5/2006 |
| DE | 10252782 | B4 | 2/2011 |
| DE | 102012025233 | A1 | 7/2014 |
| JP | H08071913 | A | 3/1996 |

OTHER PUBLICATIONS

Translation of CH669550A5 (Year: 2023).*
Search Report regarding corresponding DE App. No. 10 2019 130 933.6; dated Jul. 31, 2020.
European Search Report regarding corresponding EP App. No. 20206947.2, mailed Apr. 26, 2021.

* cited by examiner

VIBRATORY GRINDING DEVICE

CROSS-REFERENCE TO RELATED APPLICATIONS

This patent application claims the priority of German Application No. 102019130933.6, filed Nov. 15, 2019, which is incorporated herein by reference in its entirety.

The present invention relates to a vibratory grinding device for the vibratory grinding of workpieces by means of machining media in the form of grinding bodies, said vibratory grinding device having a work container for receiving the grinding bodies and the workpieces.

Such vibratory grinding devices are known from the prior art and are, for example, configured as continuous systems, centrifugal systems, round vibrators, drag grinding systems, plunge grinding systems or the like for grinding and polishing workpieces. In some of these systems, the workpieces move together with the grinding bodies in the work container, which is set into vibration by a vibration device, and are discharged from the work container together with the grinding bodies after the machining. However, if the workpieces are fixedly connected to the work container so that they vibrate together with it, the grinding bodies first have to be removed from the work container after the machining or the workpieces have to be "dug out" of the work container filled with grinding bodies. The latter is in particular disadvantageous when the workpieces are sensitive or heavy components. In both cases, the process time is hereby extended.

It is therefore the object of the present invention to provide a vibratory grinding device with which an operation, in particular an automated operation, is possible with reduced throughput times.

This object is satisfied by the features of claim 1.

In accordance with the invention, a workpiece holder is provided in the work container which is connected to it and by which at least one workpiece can be fastened to the work container in a vibration-proof manner. Furthermore, a grinding body removal device is provided that transfers the grinding bodies from the work container into an intermediate store. A batch change that is much faster and that can also be performed in an automated manner is hereby possible since the grinding bodies can be removed in an automated manner from the work container by the grinding body removal device. Surprisingly, it has namely been found that the automated removal of grinding bodies can be implemented despite their sensitivity (for example, ceramic material, glass material, and sharp-edged or thin geometries) and size—in contrast to very small and hard blasting means that is used in blasting processes. Since the grinding bodies are transferred into an intermediate store, it is additionally possible after the emptying of the work container to remove workpieces from the work container freed of grinding bodies and to clean said work container if necessary. Subsequently, the grinding bodies can be brought from the intermediate store into the work container again so that a new working cycle can begin. By removing the grinding bodies from the work container, said work container can be emptied gently so that a removal of the workpiece is possible in a damage-free manner. At the same time, the process duration is hereby reduced and the efficiency is increased since the grinding bodies can be used again for a subsequent machining process.

Advantageous embodiments of the invention are described in the description, in the drawing, and in the dependent claims.

In accordance with a first advantageous embodiment, the grinding body removal device can have a vacuum source, in particular in the form of a side channel compressor. With such a vacuum source, the comparatively large and heavy, but sensitive grinding bodies can be gently sucked out of the work container and transferred into the intermediate store.

In accordance with a further advantageous embodiment, the intermediate store can be configured as a centrifugal separator. The major advantage hereby results that the intermediate store is not only used as a store, but simultaneously serves as means to slow down the grinding bodies, which are accelerated on the sucking in, in a sufficient and damage-free manner. Damage to the grinding bodies is hereby prevented that could otherwise be a cause of the grinding bodies jamming in recesses of a workpiece in an unwanted manner.

In accordance with a further advantageous embodiment, an outlet of the intermediate store can be arranged above the work container. The temporarily stored grinding bodies can hereby be filled into the work container again by means of gravity without separate conveying means being necessary for this purpose.

In accordance with a further advantageous embodiment, the intermediate store can be provided with a vibration device. The intermediate store can hereby be set into vibration on the emptying of the grinding bodies so that the friction between the grinding bodies is eliminated in order to ensure a flowing out of the grinding bodies into the work container.

In accordance with a further advantageous embodiment, the intermediate store can have an outlet opening that can be closed by a remote-controlled closure so that a repeat filling of the work container can be performed in a remote-controlled manner without a manual intervention.

In accordance with a further advantageous embodiment, the intermediate store can have at least one filling level sensor and/or a pressure switch to enable an automated control of the emptying and of the repeat filling of the work container.

In accordance with a further advantageous embodiment, the work container can be provided with a sloping base that is inclined in the direction of an outlet opening for the grinding bodies. This promotes a sucking in of the grinding bodies by the removal device so that no grinding bodies remain within the work container on an emptying.

In accordance with a further advantageous embodiment, the intermediate store can be configured as a flatbed store that has a vacuum chamber and optionally a vibration device. Such a flatbed store has a low total height and can, for example, be configured as a vibration channel that is closed and that forms a vacuum chamber. To empty the flatbed store, it can be vibrated so that grinding bodies can be returned into the work container.

In accordance with a further advantageous embodiment, the intermediate store can have an adhesion-reducing wall that is, for example, configured as a perforated metal sheet or as a wall part provided with surface structures. In this way, it can be prevented that grinding bodies adhere to the wall of the intermediate store.

In accordance with a further advantageous embodiment, a process controller can be provided that controls an automated operation of the vibratory grinding device. Such a process controller can be configured such that a drawing off of the grinding bodies into the intermediate store is initiated, wherein, at suitable times, in particular monitored by a camera comprising an image recognition system, flushing liquid can be let into the work container and/or compressed air can be blown into the work container in order to completely remove the grinding bodies from the work container. The process controller can furthermore ensure that process liquid and/or flushing liquid is suitably drained from the work container and that the grinding body removal device or its vacuum source is suitably controlled.

At least one camera can in this respect be provided for monitoring the inner space of the work container, wherein this camera can be fastened to the lower side of a cover of the work container in an advantageous manner so that an automated process monitoring can also be performed when the work container is closed. With a computer-aided image recognition and evaluation, not only a process monitoring, but also a quality assurance can in this respect be performed in an automated manner.

It can furthermore be monitored via a filling level sensor arranged at the intermediate store with the aid of the process controller whether a refilling of grinding bodies is necessary so that they can be supplied in an automated manner from a store. Furthermore, the process controller can provide an emptying program by which the grinding bodies can be removed from the work container in a particularly gentle manner for the workpieces. Thus, a vibration of the work container can, for example, be triggered after the putting into operation of the grinding body removal device in order to discharge the grinding bodies from the work container. The process controller can in this respect control the strength of the vibration by regulating the rotational speed of the unbalance motors and it can ensure that the vibration is, for example, reduced when the grinding bodies have dropped down into the region of a workpiece located at the base of the work container. In this case, there is the risk with vibrations that are too strong that the workpiece will be damaged so that a reduction of the vibrations is advantageous at this point in time. Suitable flushing and blowing-in processes can simultaneously be triggered to gently remove all the grinding bodies from the work container.

In accordance with a further aspect, the present invention relates to a method of operating a vibratory grinding device of the above-mentioned kind, wherein first the work container is vibrated in order to set the grinding bodies located therein into motion and to grind the workpieces for a certain time. Subsequently, the grinding body removal device is put into operation to transfer the grinding bodies from the work container into the intermediate store, with the work container, however, being vibrated during this process. In this way, it is ensured that the grinding bodies located within the work container always move in the direction of the removal device due to the vibration of said work container. For an automated operation, it can be advantageous in this respect if the vibration of the work container is controlled in dependence on a pressure in the intermediate store and/or in dependence on a filling level in the intermediate store.

Figure 1:
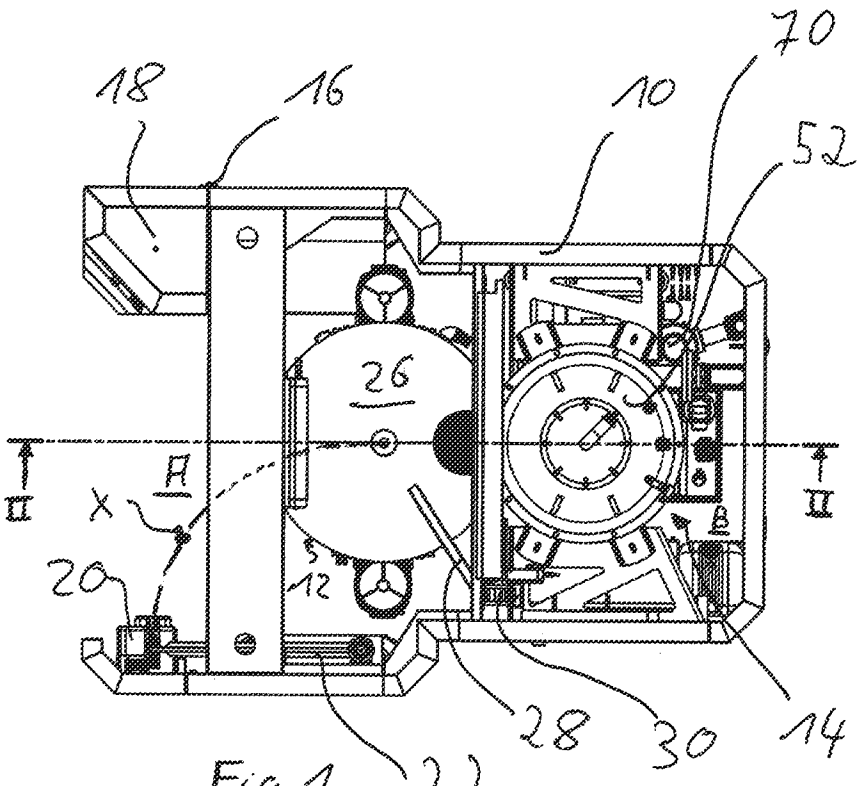
Figure 4:
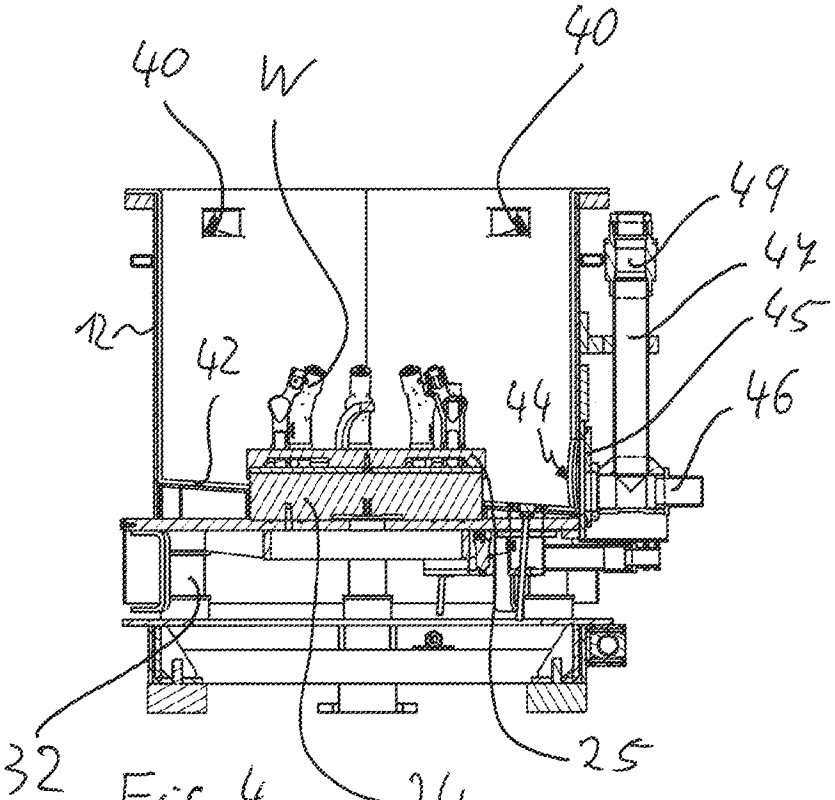
Figure 3:
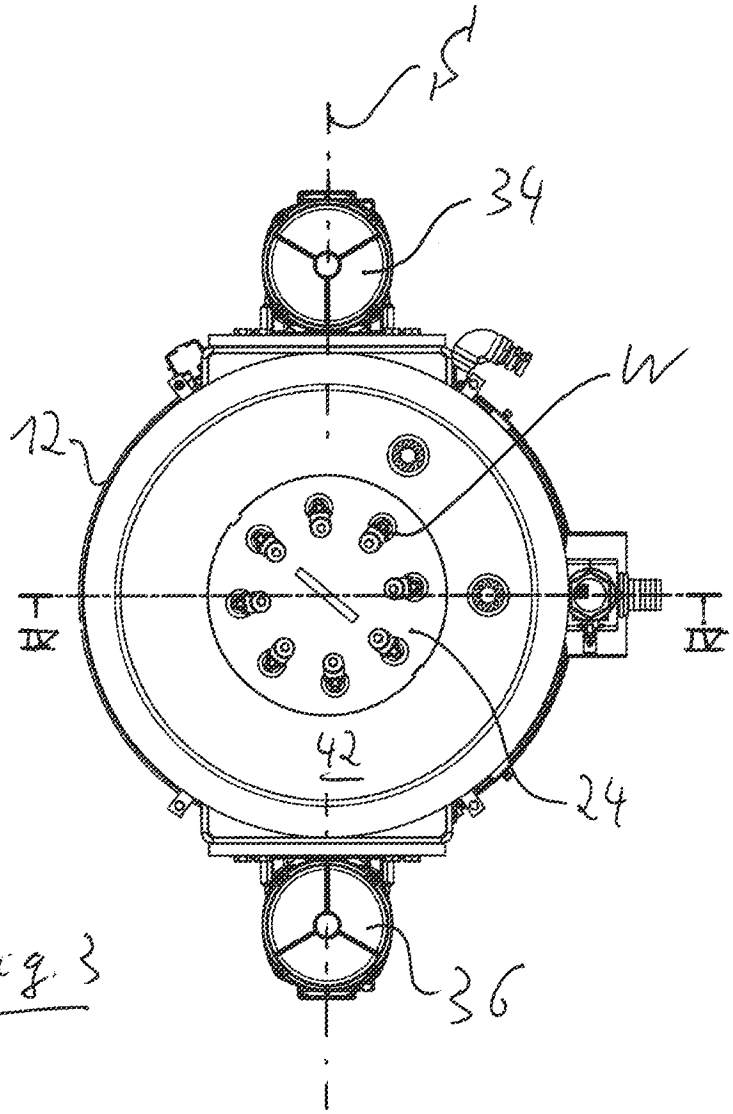
Figure 6:
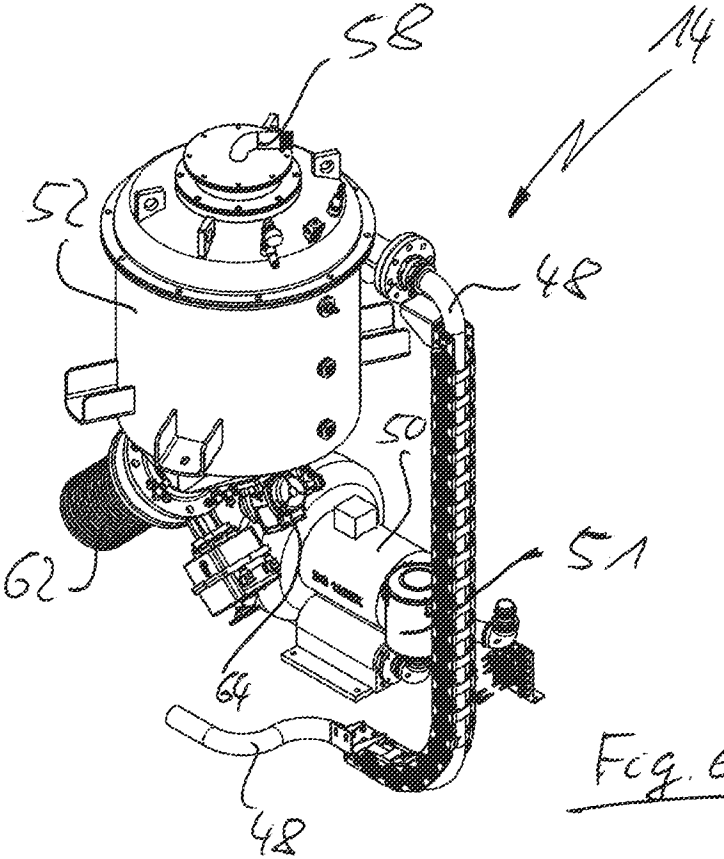
Figure 5:
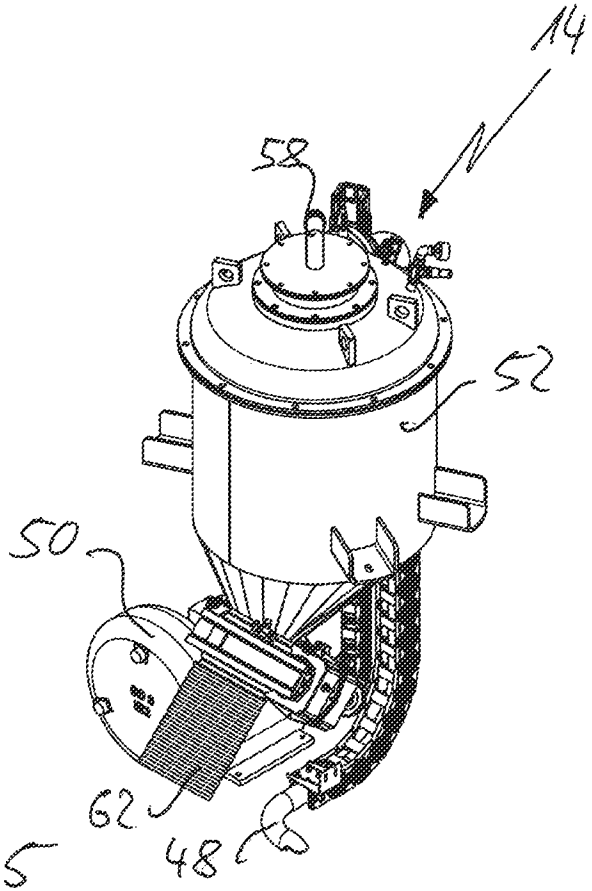

The present invention will be described in the following purely by way of example with reference to an advantageous embodiment and to the enclosed drawings. There are shown:

FIG. 1 a plan view of a vibratory grinding device;

FIG. 2 a sectional view along the line II-II of FIG. 1;

FIG. 3 a plan view of the work container of FIG. 1 with an open cover;

FIG. 4 a sectional view along the line IV-IV of FIG. 3;

FIGS. 5 and 6 perspective views of a grinding body removal device; and

Figure 7:
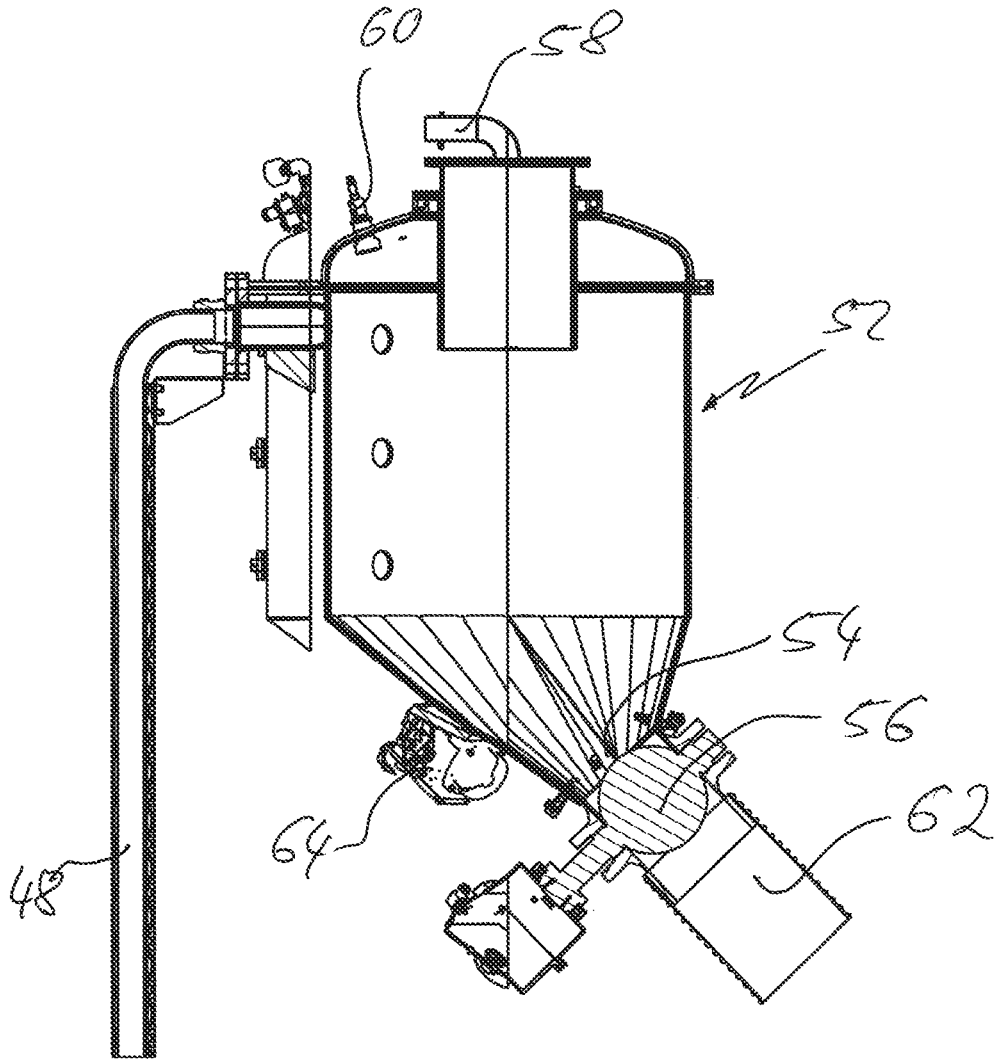

FIG. 7 a sectional view through the intermediate store of FIGS. 5 and 6.

The vibratory grinding device shown in FIGS. 1 and 2 has a housing 10 which is divided into two parts and which, in a region A open toward the front side, has a work container 12 in which workpieces are ground and/or polished in a manner known per se by means of machining media in the form of grinding bodies. The work container 12 is open at its upper side and has drain strainers at its base that enable an automatically controlled draining of liquid from the work container. In a rear, closed region B of the housing 10, a grinding body removal device 14 is provided by which the grinding bodies can be transferred from the work container 12 into an intermediate store 52. Even if this is not shown in the Figures, the housing 10 can be closed at its upper side for a sound absorption. The front side of the open region A can also be closed by a door for an improved sound absorption.

In the front region A of the housing 10 that is open to the front, a switch cabinet 18 is pivotably fastened to it via a joint 16 and extends over the total height of the housing 10. For maintenance work at the work container 12 or at the machine, the switch cabinet 18 can be pivoted clockwise to the outside in FIG. 1 in order to facilitate access to the machine.

Opposite to the switch cabinet, a lifting device 20 is pivotably fastened via a pivot arm 22 in the region A of the housing 10 so that the lifting device 20 can be pivoted over the center of the work container 12. It is hereby possible to lower workpieces or a workpiece mount 25 at the center of the work container 12 or to pick them up from the center of the work container 12. The supply and removal of such a workpiece mount 25 can take place with the aid of a transport trolley that is moved into the region A. The workpiece mount 25 can be coupled to the lifting device 20 and raised at a position X. Subsequently, the lifting device 20 is pivoted clockwise up to and over the work container 12 and is lowered, whereupon the workpiece mount 25 is located at the center of the work container 12 and at its base (cf. FIGS. 2, 3, and 4). There, the workpiece mount 25 can be fixed to a workpiece holder 24 fixedly connected to the work container 12 so that the workpiece or the workpieces are fixed to the work container 12 in a vibration-proof manner and vibrate together with it. A fixing can, for example, take place in that the workpiece holder 24 is configured as a magnetic clamping plate. Alternatively, various other embodiments of a workpiece holder can be considered, such as clamping levers, tensioning levers, screw connections, or form-fitted or force-transmitting holders.

To close the container 12, a cover 26 is provided at whose lower side at least one camera for process monitoring can be fastened. The cover 26 is fastened to a lifting device 30 via a support arm 28. With the aid of this lifting device 30, the cover 26 can be moved over the container 12 so that the cover does not touch the container, but outwardly engages around the container margin. The cover 26 can also be raised upwardly with the aid of the lifting device 30, wherein, in the raised position, the cover is automatically blocked in its raised position by a locking device.

The work container 12 with the workpiece mount 25 located therein and workpieces W mounted thereon via centering bolts is supported in a vibrating manner on a plurality of rubber buffers or dampers 32 and, in the embodiment shown, it has two unbalance motors 34 and 36 at its outer periphery that are mounted disposed opposite one another, that set the work container 12 into vibration, and that can thereby in a known manner move the grinding bodies in the container in a revolving manner. To be able to influence the movement of the grinding bodies within the work container 12, both unbalance motors 34 and 36 are adjustably mounted about an axis S extending perpendicular to the container wall so that they can be pivoted in a range from 0 to 180°. To enable a simple adjustment, each unbalance motor is mounted on a rotary disk that is only fixed with the aid of a clamping ring. In this way, only the screws of the clamping ring have to be slightly loosened for the pivoting of the unbalance motors, i.e. a complete dismantling of the unbalance motors does not have to take place. The rotational speed of the unbalance motors can be suitably regulated by a process controller, for example in a range between 600 and 3000 rpm, in order to suitably adjust the vibration amplitude of the work container as well as the direction of movement and the speed of the grinding bodies in the work container.

As in particular FIG. 4 illustrates, in the upper region of the work container 12, spray nozzles 40 are integrated into the container to be able to introduce process liquids and/or cleaning liquid or compressed air into the container. Optionally, a hand shower can also be provided in the region of the work container to clean it. Furthermore, FIG. 4 illustrates that the base of the container 12 is optionally designed as a sloping base 42 that is inclined in the direction of an outlet opening 44 provided at the outer wall of the work container 12. If grinding bodies are thus removed from the work container 12 by the grinding body removal device 14, a subsequent flow of further grinding bodies on the vibration of the work container 12 is facilitated by the sloping base 42.

From the outlet opening 44 that can be closed via a remotely controllable closure 45, the grinding bodies can enter via a connection flange 46 into a flexible pipeline 48 that is connected to the grinding body removal device 14. The grinding body removal device 14 is shown in more detail in FIGS. 5 to 7 and has a vacuum source 50 that is configured as a side channel compressor in the embodiment shown. The reference numeral 51 designates an air filter that ensures that sucked-in solids are filtered out. Furthermore, the grinding body removal device 14 is provided with an intermediate store 52 that, in the embodiment shown, is configured as a centrifugal separator or as a cyclone separator and that is shown in cross-section in FIG. 7. The centrifugal separator 52 has a generally cylindrical base body to whose lower side a funnel-shaped end section is connected that has an outlet opening 54. The outlet opening 54 can be closed by a remote-controlled closure 56. Furthermore, a suction connector 58 connected to the vacuum source 50 as well as a plurality of filling level sensors 60 and a pressure switch are located at the upper side of the intermediate store 52. The pipeline 48 is inserted tangentially into the intermediate store 52 at the upper side thereof so that, on the application of a vacuum by the putting into operation of the vacuum source 50, a vacuum is generated in the region of the suction connector 58 and sucks air and, together with the sucked-in air, grinding bodies out of the pipeline 48. They then tangentially enter into the interior of the intermediate store 52 and revolve around it along its inner wall, wherein the grinding bodies are slowed down and are accumulated in the interior of the intermediate store 52. The volume of the intermediate store 52 is in this respect selected such that the maximum volume of the grinding bodies located in work container 12 can be received.

For a setting of the vacuum in the pipeline 48, a vertical rising pipe 47 (FIG. 4) is provided in front of the connection flange 46; at the upper end of said rising pipe 47, a manually or automatically controllable closure 49 is arranged by which the air volume sucked into the pipeline 48 can be varied.

Furthermore, the described vibratory grinding device has a metering device 70 (FIG. 1) which is connected to the process controller and by which water and/or a compound can be automatically metered in. A metering device for the addition of pastes can also be provided.

With the aid of vibration sensors that are arranged at the work container 12, the total process sequence can be monitored and controlled by the process controller and can be recorded for quality assurance. In this respect, it can also be advantageous if temperature sensors are arranged in the unbalance motors to monitor them.

As FIG. 2 illustrates, the intermediate store 52 is arranged above the work container 12 and an outlet stub 62 of the intermediate store 52 is inclined in the direction of the work container 12 so that, after opening the remote-controlled closure 56, the grinding bodies can flow through the outlet opening 54 and the outlet stub 62 into the interior of the work container 12. In this respect, the outlet stub 62 is oriented such that it is not directed onto the workpieces arranged at the center of the work container, but rather into the annular intermediate space between the workpieces and the outer container wall so that sensitive workpieces are not damaged on the filling in of grinding bodies. To support this process, a vibration device 64, with whose aid the resiliently supported intermediate store 52 can be set into vibration, is further provided at the intermediate store 52 in the region of the funnel-shaped lower end.

To enable a separation of grinding bodies that have fallen below a predetermined size due to abrasion, a size classification can be performed in the return circuit between the outlet opening 44 of the work container 12 and the re-entry of the grinding bodies into the work container. For this purpose, the grinding bodies can, for example, be guided over a perforated strainer having a predetermined size so that grinding bodies with too small a size are separated out. It is understood that such a size classification in connection with a grinding body removal device can also be used with other vibratory grinding devices in which the workpieces are not fastened to the work container, but are rather moved in it together with the grinding bodies. In such a device, the workpieces together with the grinding bodies can first be led out of the work container and can then be led through a classification device in which, for example, the workpieces are separated from the grinding bodies and/or in which grinding bodies having too small a size are sorted out.

The invention claimed is:

1. A vibratory grinding device for the vibratory grinding of workpieces by means of machining media in the form of grinding bodies, said vibratory grinding device comprising:

a work container for receiving the grinding bodies, the work container having a workpiece holder, the workpiece holder being connected to the work container and with at least one workpiece being fastenable to the work container by the workpiece holder;

a nozzle for introducing process liquid into the work container;

a drain strainer at a base of the work container, the drain strainer configured to drain the process liquid from the work container;

an outlet opening at an outer wall of the work container, the outlet opening separate from and elevated from the drain strainer;

a temporary store separate from the work container; and a grinding body withdrawal device having a vacuum source that generates a vacuum and sucks air and the grinding bodies out of the work container through the outlet opening and transfers the grinding bodies to the temporary store.

2. The vibratory grinding device in accordance with claim 1, wherein the vacuum source is in the form of a side channel compressor.

3. The vibratory grinding device in accordance with claim 1, wherein the temporary store is a centrifugal separator.

4. The vibratory grinding device in accordance with claim 1, wherein an outlet opening of the temporary store is arranged above the work container.

5. The vibratory grinding device in accordance with claim 1, wherein the temporary store is provided with a vibration device.

6. The vibratory grinding device in accordance with claim 1, wherein the temporary store has an outlet opening that can be closed by a remote-controlled closure.

7. The vibratory grinding device in accordance with claim 1, wherein the temporary store has a filling level sensor.

8. The vibratory grinding device in accordance with claim 1, wherein the temporary store is configured as a flatbed store that has a vacuum chamber.

9. The vibratory grinding device in accordance with claim 8, wherein the flatbed store further has a vibration device.

10. The vibratory grinding device in accordance with claim 1, wherein the temporary store has an adhesion-reducing wall.

11. The vibratory grinding device in accordance with claim 10, wherein the adhesion-reducing wall is one of a perforated metal sheet and a wall part provided with surface structures.

12. The vibratory grinding device in accordance with claim 1, wherein a process controller is provided that has at least one camera and an image evaluation unit.

13. The vibratory grinding device in accordance with claim 1, wherein a process controller is provided that includes at least one of a filling program and an emptying program by which a vibration of the work container, the grinding body withdrawal device, and valves for controlling a supply of air or liquid are controlled.

14. The vibratory grinding device in accordance with claim 1, further comprising a device for separating grinding bodies that fall below a predetermined size.

15. The vibratory grinding device in accordance with claim 1, wherein the work container has an upper end opening and the temporary store has an outlet opening configured to allow the grinding bodies within the temporary store to flow through the upper end opening into the work container.

16. The vibratory grinding device in accordance with claim 15, wherein the outlet opening is oriented to cause the grinding bodies to flow into an annular intermediate space between the workpiece holder and the outer wall of the work container.

17. The vibratory grinding device in accordance with claim 15, wherein the temporary store has a funnel-shaped end section extending to the outlet opening.

18. A method of operating a vibratory grinding device, said vibratory grinding device comprising a work container for receiving the grinding bodies and a process liquid, the work container having a workpiece holder, the workpiece holder being connected to the work container and with at least one workpiece being fastenable to the work container by the workpiece holder; and a grinding body withdrawal device that transfers the grinding bodies from the work container into a temporary store, the method comprising the steps of:

vibrating first the work container in order to set the grinding bodies located therein into motion and to grind the workpieces;

subsequently putting the grinding body withdrawal device into operation in order to transfer the grinding bodies from the work container into the temporary store while the work container is vibrated;

draining the process liquid from the work container prior to removal of the grinding bodies from the work container; and withdrawing air and the grinding bodies together out of the work container with a vacuum source which is part of the grinding body withdrawal device.

19. The method in accordance with claim 18, wherein the vibration of the work container is controlled in dependence on a pressure in the temporary store.

20. The method in accordance with claim 18, wherein the vibration of the work container is controlled in dependence on a filling level in at least one of the temporary store and the work container.

* * * * *